US009050800B2

(12) United States Patent
Ito et al.

(10) Patent No.: US 9,050,800 B2
(45) Date of Patent: Jun. 9, 2015

(54) LIQUID EJECTING HEAD AND LIQUID EJECTING APPARATUS

(71) Applicant: Seiko Epson Corporation, Tokyo (JP)

(72) Inventors: Hiroshi Ito, Suwa (JP); Yasumi Ikehara, Suwa (JP); Jiro Kato, Suwa (JP); Hiroyuki Tomimatsu, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/019,953

(22) Filed: Sep. 6, 2013

(65) Prior Publication Data

US 2014/0002550 A1 Jan. 2, 2014

Related U.S. Application Data

(63) Continuation of application No. 13/350,526, filed on Jan. 13, 2012, now Pat. No. 8,550,602.

(30) Foreign Application Priority Data

Jan. 13, 2011 (JP) ..... 2011-004598

(51) Int. Cl.

| | |
|---|---|
| ***B41J 2/45*** | (2006.01) |
| ***B41J 2/14*** | (2006.01) |
| ***B41J 2/055*** | (2006.01) |
| ***B41J 2/16*** | (2006.01) |

(52) U.S. Cl.

CPC ..... *B41J 2/14233* (2013.01); *B41J 2/055* (2013.01); *B41J 2/161* (2013.01); *B41J 2/1623* (2013.01); *B41J 2002/14241* (2013.01); *B41J 2202/03* (2013.01)

(58) Field of Classification Search

USPC ..... 347/70

See application file for complete search history.

(56) References Cited

U.S. PATENT DOCUMENTS

| | | | | |
|---|---|---|---|---|
| 5,710,584 | A | 1/1998 | Suzuki et al. | |
| 5,896,150 | A | 4/1999 | Kobayashi et al. | |
| 6,334,672 | B1 * | 1/2002 | Matsui et al. | 347/70 |
| 2006/0152548 | A1 * | 7/2006 | Yasoshima et al. | 347/45 |
| 2006/0170737 | A1 * | 8/2006 | Ito | 347/71 |
| 2008/0239024 | A1 * | 10/2008 | Sugahara | 347/71 |
| 2009/0073207 | A1 * | 3/2009 | Takeuchi | 347/11 |

FOREIGN PATENT DOCUMENTS

| | | | |
|---|---|---|---|
| JP | 2000-103059 | A | 4/2000 |
| JP | 2003-205611 | A | 7/2003 |
| JP | 2004-262225 | A | 9/2004 |
| JP | 2006-082529 | A | 3/2006 |
| JP | 2006-175654 | A | 7/2006 |

* cited by examiner

*Primary Examiner* — Stephen Meier
*Assistant Examiner* — Alexander D Shenderov
(74) *Attorney, Agent, or Firm* — Kilpatrick Townsend & Stockton LLP

(57) ABSTRACT

A liquid ejecting head comprises a pressure generation chamber communicating with a nozzle opening, a vibrating wall provided as one surface of the pressure generation chamber and vibrates so that ejects the liquid from the nozzle opening, and a resin portion having a recessed arc-shape and formed in a corner of the pressure generation chamber and formed of a resin material having a Young's modulus of less than or equal to 10 GPa. A ratio r/w of a radius r of the surface of the resin portion to a width w of the pressure generation chamber defined by the vibrating wall is greater than or equal to 0.017 and less than or equal to 0.087.

17 Claims, 5 Drawing Sheets

LIQUID EJECTING HEAD AND LIQUID EJECTING APPARATUS

CROSS-REFERENCE TO RELATED APPLICATIONS

This application is a continuation of U.S. application Ser. No. 13/350,526 filed on Jan. 13, 2012, which claims priority to Japanese Patent Application No. 2011-004598, filed Jan. 13, 2011, the entireties of which are expressly incorporated by reference.

BACKGROUND

1. Technical Field

The present invention relates to liquid ejecting heads that eject liquid from a nozzle opening and liquid ejecting apparatuses, and particularly relates to ink jet recording heads that eject ink as a liquid and ink jet recording apparatuses.

2. Related Art

There has been proposed an ink jet recording head, serving as a liquid ejecting head, that includes a flow channel formation board in which pressure generation chambers that are open on one surface are formed, piezoelectric actuators provided over a vibrating plate that forms one surface of the pressure generation chambers, and a nozzle plate that is affixed to the surface of the flow channel formation board in which the pressure generation chambers are provided using an adhesive and that is provided with nozzle openings that communicate with the pressure generation chambers; a protective film that is ink-resistant is provided on the inner surface of the pressure generation chambers in the flow channel formation board and so on (for example, see JP-A-2006-082529).

In addition, there has been proposed a liquid ejecting head in which, when an adhesive that affixes a flow channel formation board and a nozzle plate to each other flows to the top of a vibrating plate of pressure generation chambers due to capillarity, the adhesive that has flowed to the top of the vibrating plate is removed because a drop in the displacement of the vibrating plate due to the adhesive that has flowed in this manner will occur (for example, see JP-A-2006-175654).

However, there is a problem in that, if the adhesive is removed from the top of the vibrating plate within the pressure generation chamber and the vibrating plate is then caused to displace, as is the case in JP-A-2006-175654, cracks will appear in the protective film on the vibrating plate and the flow channel formation board will be corroded by the ink through the cracks, which reduces the durability of the flow channel formation board.

There is also a problem in that there is a risk that the protective film will peel off due to the cracks, producing foreign objects that can block the nozzle openings (that is, cause ink ejecting malfunctions).

Furthermore, there is yet another problem in that if the amount of adhesive that flows to the top of the vibrating plate is too high, the adhesive will interfere with the displacement of the vibrating plate, causing a drop in displacement that in turn leads to a drop in the ink ejection properties.

It should be noted that these problems are not limited to ink jet recording heads, and are also present in other liquid ejecting heads that eject liquids aside from ink.

SUMMARY

It is an advantage of some aspects of the invention to provide a liquid ejecting head and a liquid ejecting apparatus capable both of improving the durability by suppressing a protective layer from peeling off, and of suppressing liquid ejection malfunctions, a significant drop in liquid ejection properties, and so on.

A liquid ejecting head according to an aspect of the invention includes a pressure generation chamber that communicates with a nozzle opening for ejecting a liquid, a vibrating plate that defines one surface of the pressure generation chamber, and a liquid-resistant protective film provided on the inner surface of the pressure generation chamber, and ejects the liquid from the nozzle opening by causing the vibrating plate to vibrate and instigate a change in the pressure of the liquid within the pressure generation chamber. Resin portions having a recessed arc-shape are formed in corner portions within the pressure generation chamber on the side of the vibrating plate, and are formed of a resin material that covers the corner portion and has a Young's modulus of less than or equal to 10 GPa; and a ratio r/w of a radius r of the surface of the resin portions to a width w of the side of the pressure generation chamber defined by the vibrating plate is greater than or equal to 0.017 and less than or equal to 0.087.

According to this aspect, by providing the resin portions and defining the ratio of the radius r of the resin portions, the resin portions can alleviate stress at the corner portions of the protective film while a significant drop in the displacement of the vibrating plate is suppressed; this makes it possible to suppress the occurrence of cracks in the protective film, problems such as the protective film peeling off, and so on.

Here, it is preferable for the protective film to be formed of tantalum oxide. According to this aspect, employing the protective film configured of tantalum oxide makes it possible to protect the flow channel formation board, which is configured of a silicon single-crystal substrate, glass, or the like, from the liquid.

Furthermore, it is preferable for the resin portions to be formed of an adhesive used when affixing a nozzle plate in which the nozzle opening is provided to the flow channel formation board. According to this aspect, the process for forming the resin portions can be simplified, and costs can be reduced as a result.

Furthermore, it is preferable for the resin portions to be configured of an epoxy-based adhesive. According to this aspect, the epoxy-based adhesive has superior gas barrier properties with respect to water vapor, and thus a good airtight seal can be created.

Furthermore, another aspect of the invention is a liquid ejecting apparatus including the liquid ejecting head according to the aforementioned aspects.

According to this aspect, it is possible to provide a liquid ejecting apparatus having improved durability and print quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on embodiments.

First Embodiment

Figure 1:
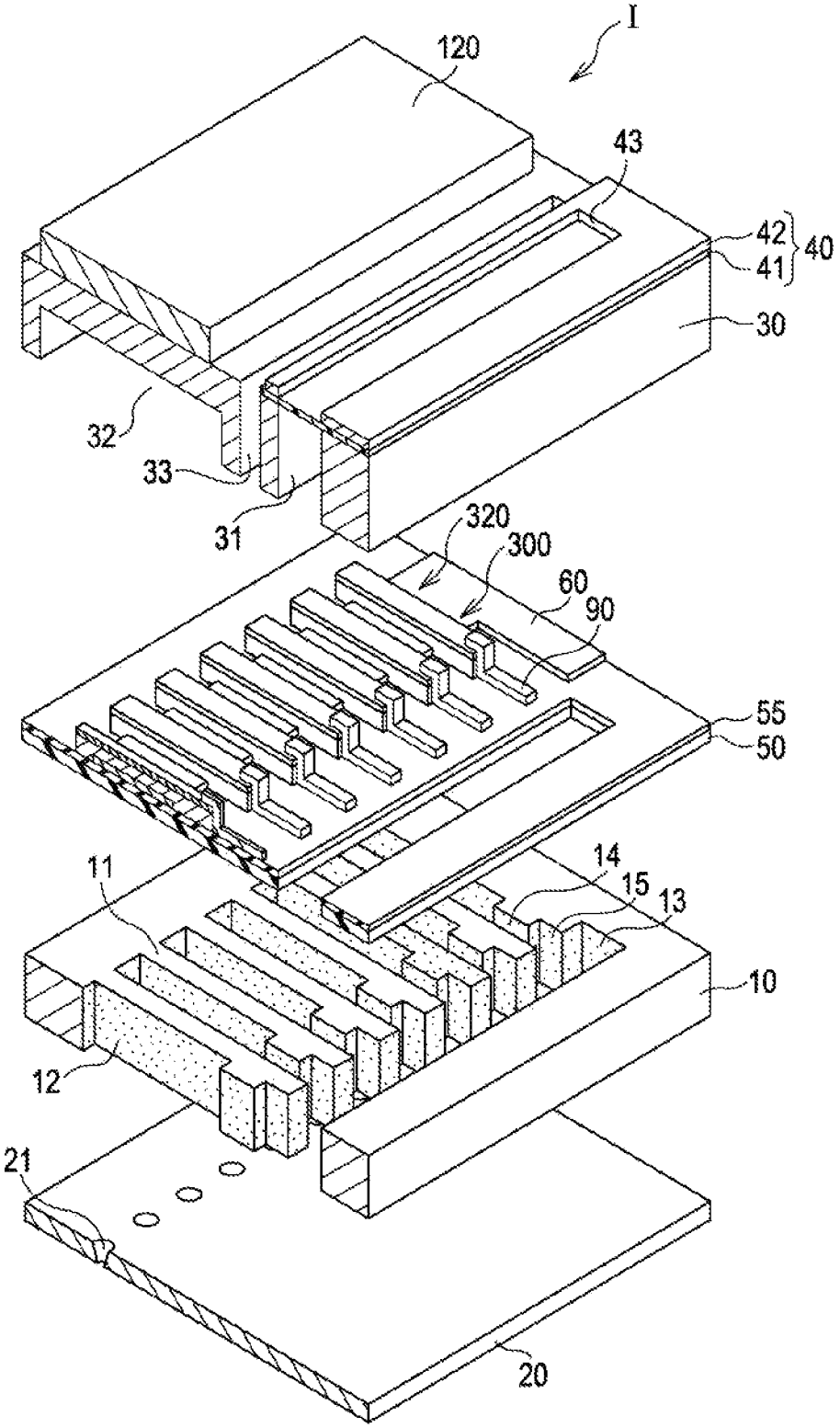
FIG. 1 is an exploded perspective view of a recording head according to a first embodiment.
Figure 2A:
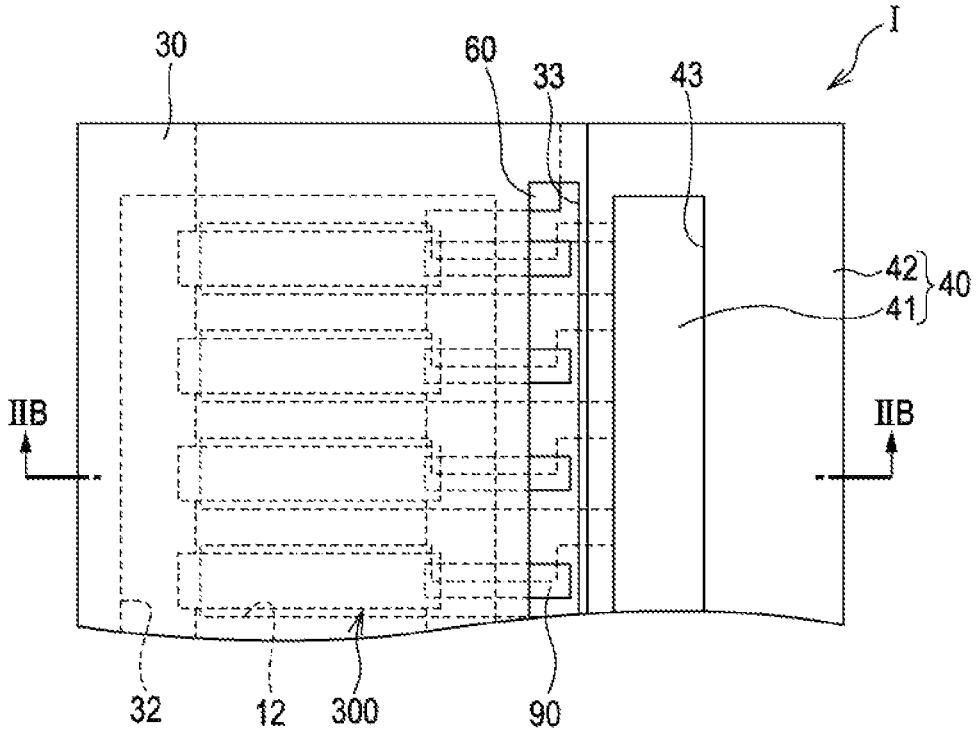
FIGS. 2A and 2B are a plan view and a cross-sectional view, respectively, of the recording head according to the first embodiment.
Figure 2B:
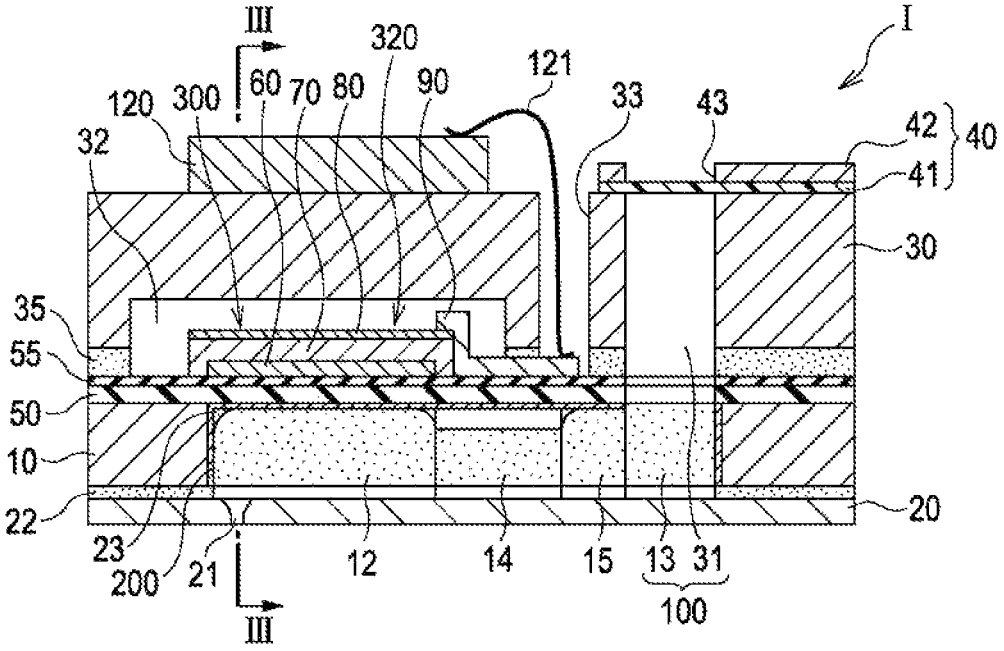
Figure 3:
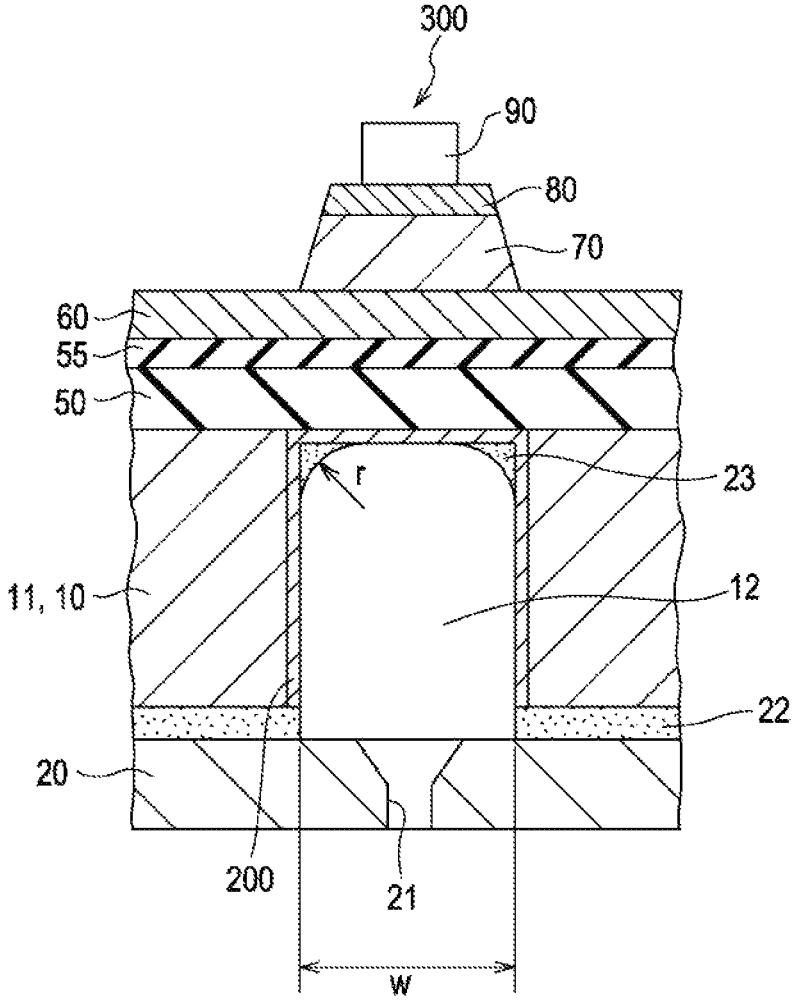
FIG. 3 is an enlarged cross-sectional view illustrating the primary elements of the recording head according to the first embodiment.

FIG. 1 is an exploded perspective view illustrating an ink jet recording head serving as an example of a liquid ejecting head according to a first embodiment of the invention; FIGS. 2A and 2B are a plan view in FIG. 1 and a cross-sectional view taken along the IIB-IIB line in FIG. 2A; FIG. 3 is a cross-sectional view taken along the III-III line in FIG. 2B.

As shown in these drawings, a flow channel formation board 10 is, in this embodiment, configured of a plane orientation (110) silicon single-crystal substrate, and an elastic membrane 50, configured of silicon dioxide and having a thickness of 0.5 to 2 μm, is formed on one surface thereof.

Pressure generation chambers 12 are arranged in parallel along the width direction (that is, the widthwise direction) thereof by a plurality of partition walls 11 formed through anisotropic etching from the reverse side, in the flow channel formation board 10. Furthermore, ink supply channels 14 and communication channels 15 are formed by the partition walls 11 on one end in the lengthwise direction of the pressure generation chambers 12 in the flow channel formation board 10. At one end of the communication channels 15, a communication portion 13 that configures part of a manifold 100 is formed, the manifold 100 serving as an ink chamber (a liquid chamber) that is common for all of the pressure generation chambers 12. In other words, liquid flow channels configured of the pressure generation chambers 12, the communication portion 13, the ink supply channels 14, and the communication channels 15 are provided in the flow channel formation board 10.

The ink supply channels 14 communicate with the pressure generation chambers 12 on one side in the lengthwise direction thereof, and have a cross-sectional surface area that is smaller than the pressure generation chambers 12. For example, in this embodiment, the ink supply channels 14 cause the area of the flow channel that is located toward the pressure generation chambers 12 between the manifold 100 and the pressure generation chambers 12 to narrow in the width direction, and thus a width that is less than the width of the pressure generation chambers 12 is formed. However, although the ink supply channels 14 are formed so that the width of the flow channel narrows from one side in this embodiment, it should be noted that the ink supply channels may be formed so that the width of the flow channel narrows from both sides. Furthermore, the width of the flow channel need not be narrowed, and the ink supply channels may instead be formed so as to narrow in the thickness direction. Furthermore, the respective communication channels 15 communicate with the opposite side of the pressure generation chambers 12 of the ink supply channels 14, and have a cross-sectional surface area that is greater than the width direction (the widthwise direction) of the ink supply channels 14. In this embodiment, the communication channels 15 and the pressure generation chambers 12 are formed so as to have the same cross-sectional surface area.

In other words, the pressure generation chambers 12, the ink supply channels 14, and the communication channels 15 are provided in the flow channel formation board 10 defined by the plurality of partition walls 11. In addition, one side for the pressure generation chambers 12 of the flow channel formation board 10 is formed by the elastic membrane 50, which configures a vibrating plate.

Here, a protective film 200 configured of a material that is ink-resistant (liquid-resistant), such as tantalum oxide ($TaO_x$; amorphous), is provided on the inner wall surface (inner surface) of the liquid flow channels configured of the pressure generation chambers 12, the communication portion 13, the ink supply channels 14, and the communication channels 15 of the flow channel formation board 10. Note that the material for the protective film 200 is not limited to tantalum oxide, and depending on the pH value of the ink that is used, silicon oxide ($SiO_2$), zirconium oxide ($ZrO_2$), nickel (Ni), chromium (Cr), or the like may be used.

The protective film 200 may have any thickness as long as it is a thickness that prevents the flow channel formation board 10 from being corroded by the ink; in this embodiment, a thickness of approximately 50 nm is provided. Furthermore, "ink-resistant" mentioned here refers to a resistance to etching by an alkaline ink. In this manner, providing the protective film 200 on the inner surface of the liquid flow channels in the flow channel formation board 10 makes it possible to prevent the flow channel formation board 10 from being corroded by the ink.

Meanwhile, a nozzle plate 20, in which are provided nozzle openings 21 that communicate with the pressure generation chambers 12 near the ends thereof on the opposite side to the ink supply channels 14, is affixed, using an adhesive 22, to the surface of the flow channel formation board 10 into which the liquid flow channels such as the pressure generation chambers 12 open. The nozzle plate 20 is configured of, for example, a glass ceramic, a silicon single-crystal substrate, stainless steel, or the like. Meanwhile, an epoxy-based adhesive, for example, can be used as the adhesive 22. Epoxy-based adhesives have superior wettability with silicon, silicon oxide, and so on, and have superior gas barrier properties with respect to water vapor, and are thus capable of providing good airtight seals.

As described above, the elastic membrane 50, which is, for example, 1.0 μm thick, is formed upon the surface of the flow channel formation board 10 on the opposite side to the nozzle plate 20, and an insulation film 55, configured of approximately 0.4 μm-thick zirconium oxide, is formed upon the elastic membrane 50. Furthermore, a piezoelectric actuator 300 is configured by layering, upon the insulation film 55, a first electrode 60 having a thickness of, for example, approximately 0.2 μm, a piezoelectric material layer 70 having a thickness of, for example, approximately 1.0 μm, and a second electrode 80 having a thickness of, for example, approximately 0.05 μm. Here, "piezoelectric actuator 300" refers to the portion that includes the first electrode 60, the piezoelectric material layer 70, and the second electrode 80. Generally speaking, one of the electrodes in the piezoelectric actuator 300 serves as a common electrode, whereas the other electrode and the piezoelectric material layers 70 are configured through patterning carried out for each of the pressure generation chambers 12. Furthermore, here, the portion configured from one of the electrodes obtained through patterning and the piezoelectric material layer 70, and in which piezoelectric strain occurs when a voltage is applied to the two electrodes, is referred to as a "piezoelectric functional portion". In this embodiment, the first electrode 60 serves as the common electrode for the piezoelectric actuator 300 and the second electrode 80 serves as an individual electrode for the piezoelectric actuator 300; however, this may be reversed with no ill effects if required by a driving circuit, wiring pattern, and so on. In either case, a piezoelectric functional portion is formed in correspondence with each pressure generation chamber. Although the elastic membrane 50, the insulation film 55, and the first electrode 60 act as the vibrating plate in the stated example, it should be noted that the invention is of course not limited thereto; for example, the first electrode 60 alone may act as the vibrating plate, and the elastic membrane 50 and insulation film 55 may be omitted. Furthermore, the piezoelectric actuator 300 itself may essentially play the role of the vibrating plate as well.

Here, as shown in FIG. 3, in the corner areas of the pressure generation chambers 12 on the side of the vibrating plate (elastic membrane 50), or in other words, in the corner areas that are at the borders between the partition walls 11 and the elastic membrane 50 and that are formed by the partition walls 11 and the elastic membrane 50, resin portions 23, configured of a resin material having a Young's modulus of less than or equal to 10 GPa, are formed so as to cover those corner portions. Here, the resin portions 23 are formed upon the protective film 200, and may be provided in at least the corners on both sides in the direction in which the pressure generation chambers 12 are arranged in parallel. In this embodiment, the resin portions 23 are formed so as to continue along the corner portions partitioned by the liquid flow channels of the flow channel formation board 10 and the elastic membrane 50.

In addition, the resin portions 23 are shaped as a curved surface that is recessed in an arc shape. In other words, the resin portions have an approximately triangular shape that spans the partition walls 11 and the elastic membrane 50, and the surface of this triangular shape that faces toward the pressure generation chamber 12 (that is, the surface that connects the surface of the partition wall 11 with the surface of the elastic membrane 50) is an arc-shaped recess.

Although the material of the resin portions 23 is not particularly limited as long as it is a resin material having a Young's modulus of less than or equal to 10 GPa, it is favorable to use an epoxy-based resin having superior wettability with respect to silicon, silicon oxide, and so on. In terms of a method for forming the resin portions 23, in this embodiment, the resin portions 23 are formed by causing the adhesive 22 to traverse the corner portions of the pressure generation chambers 12 through the effects of capillarity when the nozzle plate 20 and the flow channel formation board 10 are affixed to each other. Note that the resin portions 23 can also be formed by directly applying or dripping the resin material on the corner portions defined by the partition walls 11 and the elastic membrane 50.

With respect to the resin portions 23, a ratio (r/w) of the radius r of the arc-shaped recess in the surface of the resin portions 23 to the width w of a vibrating portion, which is a region in the arrangement direction of the pressure generation chambers 12 in which the protective film 200 of the vibrating plate (elastic membrane 50) within the pressure generation chambers 12 is not formed, is greater than or equal to 0.017 and less than or equal to 0.087.

By setting the ratio (r/w) of the radius r of the resin portions 23 to the width w of the vibrating portion of the vibrating plate to greater than or equal to 0.017 in this manner, it is possible to suppress the appearance of cracks in the protective film 200, particularly in the regions opposite to the corner portions defined by the partition walls 11 and the elastic membrane 50, caused by the displacement of the vibrating plate. In other words, corner portions that have the same shape as the corner portions defined by the partition walls 11 and the elastic membrane 50 are formed in the protective film 200, and thus cracks form, starting at those corner portions, due to the occurrence of stress at the corner portions. However, in this embodiment, providing the resin portions 23 in these corner portions makes it possible to alleviate the stress that concentrates at the corner portions of the protective film 200 and reduce the occurrence of cracks in the protective film 200.

On the other hand, by setting the ratio (r/w) of the radius r of the resin portions 23 to the width w of the vibrating portion of the vibrating plate to less than or equal to 0.087, the resin portions 23 suppress a significant drop in the displacement of the vibrating plate, which makes it possible to suppress the occurrence of a drop or variance in the ink ejection properties. In other words, defining the radius r of the resin portions 23 means defining the amount by which the resin portions 23 protrude upon the vibrating plate (the elastic membrane 50) (that is, the width of the resin portions 23); although the displacement of the vibrating plate will drop significantly if the amount of protrusion (width) is too high, in this embodiment, the radius r of the resin portions 23 is regulated, which makes it possible to suppress a significant drop in the displacement of the vibrating plate.

Note that as described above, in the case where the resin portions 23 are formed by the adhesive 22 that affixes the nozzle plate 20 to the flow channel formation board 10, the material of the adhesive 22 can be controlled by adjusting the pressure at which the nozzle plate 20 and the flow channel formation board 10 are pressurized, the heating temperature, the heating time, and so on. In this embodiment, an epoxy-based low temperature-curable type, called Ablebond 342-37 (product name; manufactured by Ablestik (Japan) Co., Ltd.), which has a viscosity of 1,000 cp to 14,000 cp, is used as the adhesive for affixing the nozzle plate 20 to the flow channel formation board 10. Note that this adhesive begins curing at a temperature range from normal temperature (25° C.) to 150° C., and finishes curing from 48 hours to 2 hours. In addition, Ablebond 342-37 has a Young's modulus of less than or equal to 1 GPa after curing.

Figure 4A:
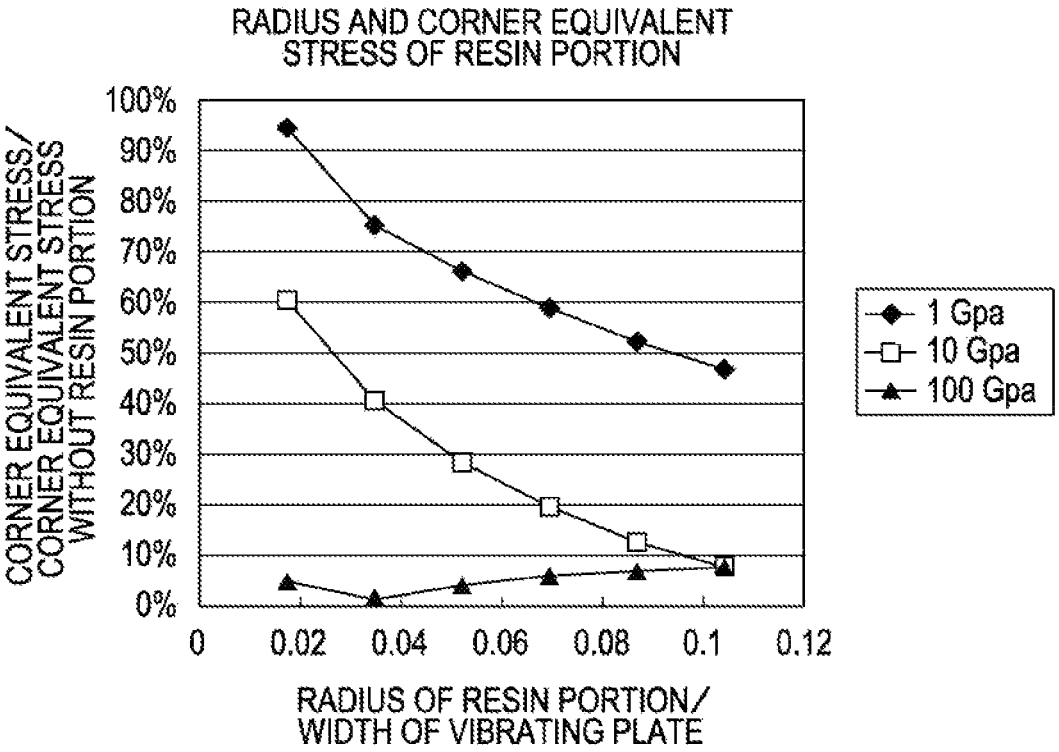
FIGS. 4A and 4B are graphs illustrating calculation results according to the first embodiment.
Figure 4B:
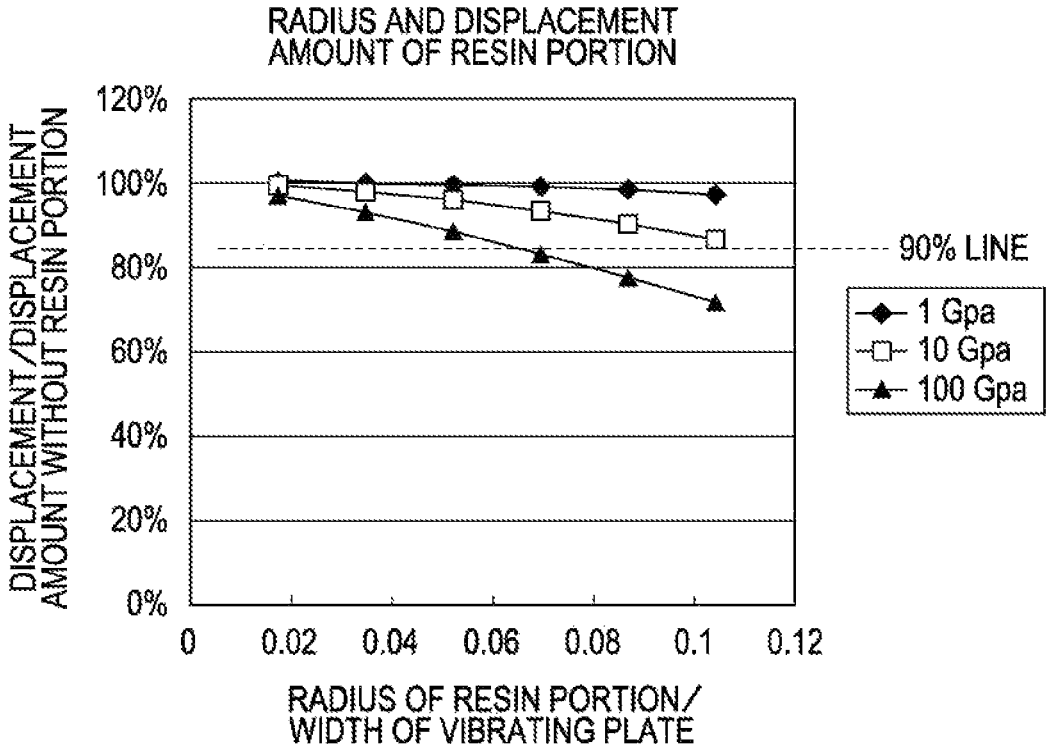

Here, in the case where the radius of the resin portions 23 has been changed and the Young's modulus has changed, the displacement amount of the vibrating plate and the equivalent stress that serves as a benchmark for breakage in the corner portions between the partition walls 11 and the elastic membrane 50 (that is, the protective film 200) are calculated using a finite element method. The results are shown in FIGS. 4A and 4B. Note that FIG. 4A is a graph illustrating the results of calculating the equivalent stress of the corner portions in the case where the resin portions 23 have been provided and the ratio of the radius r of the resin portions 23 relative to the width w of the vibrating portion of the vibrating plate having been changed, against the equivalent stress (100%) of the corner portions when the resin portions 23 are not provided. Meanwhile, FIG. 4B illustrates the results of changing the ratio of the radius r of the resin portions 23 relative to the width w of the vibrating portion of the vibrating plate, against the displacement amount (100%) of the vibrating plate in the case where the resin portions 23 are not provided.

As shown in FIG. 4A, with respect to the equivalent stress (100%) of the corner portions when the resin portions 23 are not provided, providing the resin portions 23 to even a small extent makes it possible to reduce the equivalent stress in the corner portions. In this calculation, the effect in which the equivalent stress of the corner portions can be reduced by providing the resin portions 23 appears in the actual ratio (r/w), where the minimum value is 0.017. Note that the equivalent stress in the corner portions can be reduced by providing the resin portions 23 regardless of whether the Young's modulus of the resin portions 23 is 1 GPa, 10 GPa, or 100 GPa.

Meanwhile, as shown in FIG. 4B, the displacement amount of the vibrating plate drops as the ratio of the radius r of the resin portions 23 to the width w of the vibrating portion of the vibrating plate increases, with respect to the displacement amount (100%) of the vibrating plate in the case where the resin portions 23 are not provided. At this time, if the resin portions 23 have a Young's modulus of 10 GPa, the displacement amount of the vibrating plate is 90% when the ratio (r/w) is 0.087. Incidentally, in the case where resin portions having a Young's modulus of 100 GPa are provided, it is necessary to further reduce the ratio (r/w) of the resin portions, or in other words, reduce the amount by which the resin portions protrude (the radius r) in order to achieve a displacement amount of 90% in the vibrating plate with respect to the case where the resin portions are not provided; however, because the post-curing Young's modulus of the resin typically used as the adhesive 22 is less than or equal to 10 GPa, the resin was limited to one in which the Young's modulus is less than or equal to 10 GPa in this embodiment. Likewise, if the resin portions have a Young's modulus of 1 GPa, the ratio (r/w) of the resin portions may be further increased for a displacement amount of 90% in the vibrating plate.

Based on these results, in this embodiment, employing the resin portions 23 that are formed of a resin material having a Young's modulus of less than or equal to 10 GPa and setting the ratio (r/w) of the radius r of the resin portions 23 to the width w of the vibrating portion to be greater than or equal to 0.017 and less than or equal to 0.087 make it possible to reduce the equivalent stress at the corner portions of the protective film 200, which in turn makes it possible to suppress the occurrence of breakage, such as cracks, in the protective film 200. If cracks appear in the protective film 200, ink will penetrate into the cracks and the flow channel formation board 10 will be corroded by the ink. Furthermore, the protective film 200 will peel off due to the cracks, producing foreign objects, which in turn will result in clogs in the nozzle openings 21 (that is, ink ejection malfunctions). However, in this embodiment, by suppressing cracks from occurring in the protective film 200, it is possible to suppress the flow channel formation board 10 from being corroded by ink and improve the durability thereof, and it is possible to suppress the occurrence of problems such as ink ejection malfunctions.

Furthermore, in this embodiment, defining the ratio (r/w) of the radius r of the resin portions 23 to the width w of the vibrating portion of the vibrating plate makes it possible to suppress a significant drop in the displacement amount (that is, when the displacement amount drops below 90%) of the vibrating plate caused by providing the resin portions 23. Note that the displacement amount of the vibrating plate is changed ± approximately 10% due to error and the like when manufacturing the ink jet recording head I, and heads in which the displacement amount has dropped less than 10% can be used as products by configuring the characteristics of driving signals and so on.

Lead electrodes 90, which are configured of gold (Au) or the like and extend to the vicinity of the end of the flow channel formation board 10 on the opposite side to the ink supply channels 14, are connected to the respective second electrodes 80 of the piezoelectric actuators 300. Through these lead electrodes 90, voltages are selectively applied to the respective piezoelectric actuators 300.

A protective substrate 30, having a manifold portion 31 that configures at least part of the manifold 100, is affixed, using an adhesive 35, to the top of the flow channel formation board 10 in which the piezoelectric actuators 300 are formed, or in other words, is affixed above the first electrode 60, the elastic membrane 50, and the lead electrodes 90. In this embodiment, the manifold portion 31 is formed so as to pass through the protective substrate 30 in the thickness direction thereof and so as to span across the width direction of the pressure generation chambers 12, and by communicating with the communication portion 13 of the flow channel formation board 10 as described above, configures the manifold 100, which serves as a common ink chamber for the pressure generation chambers 12.

Meanwhile, a piezoelectric actuator holding portion 32, having a space of a size that does not interfere with the movement of the piezoelectric actuators 300, is provided in a region of the protective substrate 30 that opposes the piezoelectric actuators 300. The piezoelectric actuator holding portion 32 may have a space of any size as long as the space does not interfere with the movement of the piezoelectric actuators 300, and the space may or may not be sealed.

It is preferable to use a material having essentially the same coefficient of thermal expansion as the flow channel formation board 10, such as glass, a ceramic material, or the like as the protective substrate 30; in this embodiment, the protective substrate 30 is formed using the same type of silicon single-crystal substrate as the flow channel formation board 10.

Meanwhile, a through-hole 33 that passes through the protective substrate 30 in the thickness direction thereof is provided in the protective substrate 30. The vicinities of the ends of the lead electrodes 90, which are led out from their corresponding piezoelectric actuators 300, are provided so as to be exposed within the through-hole 33.

Furthermore, a driving circuit 120 for driving the piezoelectric actuators 300 that are arranged in parallel is affixed upon the protective substrate 30. For example, a circuit board, a semiconductor integrated circuit (IC), or the like can be used as the driving circuit 120. The driving circuit 120 and the lead electrodes 90 are electrically connected via connection wires 121, which are configured of conductive wires such as bonding wires.

Furthermore, a compliance substrate 40, configured of a sealing membrane 41 and an anchoring plate 42, is affixed to the top of the protective substrate 30. Here, the sealing membrane 41 is configured of a flexible material having a low rigidity (for example, a 6 μm-thick polyphenylene sulfide (PPS) film), and one surface of the manifold portion 31 is sealed by the sealing membrane 41. The anchoring plate 42, meanwhile, is formed of a hard material such as a metal or the like (for example, 30 μm-thick stainless steel (SUS)). The region of the anchoring plate 42 that opposes the manifold 100 has an opening portion 43 in which the anchoring plate 42 has been completely removed in the thickness direction, and thus one surface of the manifold 100 is sealed using only the flexible sealing membrane 41.

With the ink jet recording head according to this embodiment, ink is imported from an ink introduction port connected to an external ink supply unit (not shown), and after the interior spanning from the manifold 100 to the nozzle openings 21 has been filled with ink, the voltages are applied between the first electrode 60 and second electrodes 80 corresponding to the respective pressure generation chambers 12 in accordance with recording signals from the driving circuit 120; as a result, the elastic membrane 50, the insulation film 55, the first electrode 60, and the piezoelectric material layer 70 bend and deform, causing the pressure within the pressure generation chambers 12 to increase and ejecting ink droplets from the nozzle openings 21 as a result.

Other Embodiments

Although the first embodiment of the invention has been described thus far, the basic configuration of the invention is not intended to be limited to that described above. Although the stated first embodiment describes the elastic membrane 50 that configures the vibrating plate as defining one surface of the pressure generation chambers 12 in the flow channel formation board 10, the invention is not particularly limited thereto, and the invention can be applied in an ink jet recording head in which the partition walls 11 act as the vibrating plate as well.

Furthermore, although the stated first embodiment describes a thin-film piezoelectric actuator 300 as being used as a pressure generation unit that ejects ink droplets from the nozzle openings 21, the invention is not particularly limited thereto; for example, a thick-film piezoelectric actuator formed through a method such as applying a green sheet, a longitudinally-vibrating piezoelectric actuator that extends and contracts in the axial direction, formed by alternately layering piezoelectric material and electrode formation material, and so on may be used as well.

Furthermore, although the stated first embodiment is described using the piezoelectric actuator 300 as a pressure generation unit that ejects ink droplets from the nozzle openings 21, the invention is not particularly limited thereto; for example, what is known as a static actuator, in which static electricity is generated between the vibrating plate and an electrode and liquid droplets are ejected from nozzle openings by using the force of the static electricity to deform the vibrating plate, can be used as well.

Furthermore, although the stated first embodiment describes an example in which the flow channel formation board 10 is a crystalline plane orientation (110) silicon single-crystal substrate, the invention is not particularly limited thereto; for example, a crystalline plane orientation (100) silicon single-crystal substrate may be used, or an SOI substrate, a material such as glass, or the like may be used.

Figure 5:
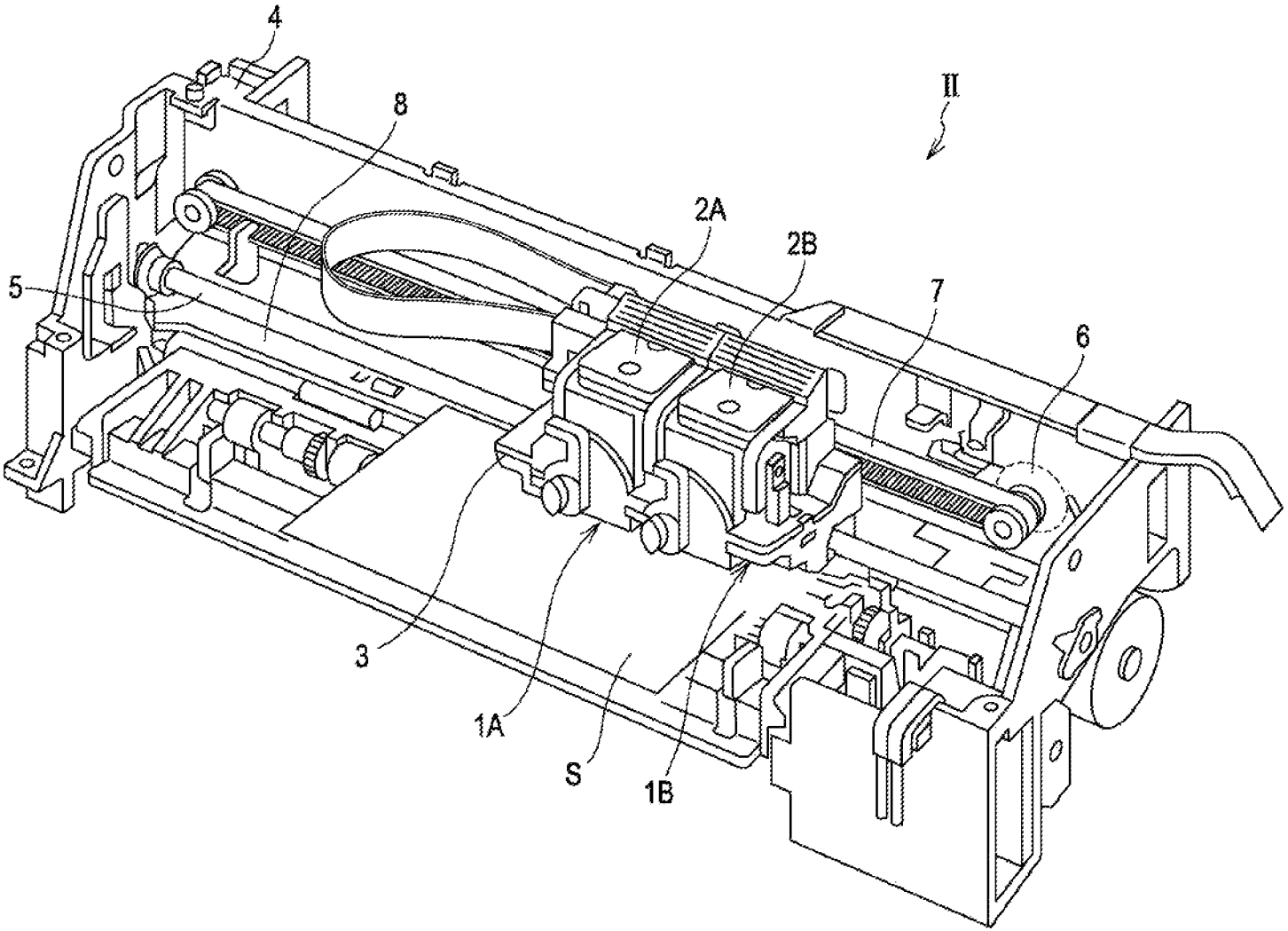
FIG. 5 is a general diagram illustrating an outline of an ink jet recording apparatus according to an embodiment.

The ink jet recording head according to the aforementioned embodiments configures part of a recording head unit including an ink flow channel that communicates with an ink cartridge or the like, which is in turn installed in an ink jet recording apparatus. FIG. 5 is a general diagram illustrating an example of such an ink jet recording apparatus.

As shown in FIG. 5, in recording head units 1A and 1B that have ink jet recording heads, cartridges 2A and 2B that configure ink supply units are provided so as to be removable; a carriage 3, in which these recording head units 1A and 1B are installed, is provided so as to move freely in the axial direction of a carriage shaft 5 attached to an apparatus main body 4. These recording head units 1A and 1B each eject, for example, black ink compositions and color ink compositions.

Transmitting driving force generated by a driving motor 6 to the carriage 3 via a plurality of gears (not shown) and a timing belt 7 moves the carriage 3, in which the recording head units 1A and 1B are installed, along the carriage shaft 5. Meanwhile, a platen 8 is provided in the apparatus main body 4 along the same direction as the carriage shaft 5, and a recording sheet S, which is a recording medium such as paper supplied by paper supply rollers and the like (not shown), is entrained and transported by the platen 8.

In addition, although the above descriptions of the ink jet recording apparatus II illustrate an example in which the ink jet recording head I (the head units 1A and 1B) is mounted in the carriage 3 and moves along the main scanning direction, the invention is not particularly limited thereto; for example, the invention can also be applied in a so-called line-type recording apparatus, in which the ink jet recording head I is anchored and printing is performed simply by moving the recording sheet S, which is paper or the like, in the sub scanning direction.

Although the stated embodiments describe an ink jet recording head as an example of a liquid ejecting head and an ink jet recording apparatus as an example of a liquid ejecting apparatus, the invention applies generally to all types of liquid ejecting heads and liquid ejecting apparatuses, and can of course be applied in liquid ejecting heads, liquid ejecting apparatuses, and so on that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads; the invention can also be applied in liquid ejecting apparatuses that include such liquid ejecting heads.

What is claimed is:

1. A liquid ejecting head, comprising:

a pressure generation chamber communicating with a nozzle opening, wherein partition walls define a sidewall surface of the pressure generation chamber and a vibrating wall that vibrates so as to eject liquid from the nozzle opening defines a top surface of the pressure generation chamber, the pressure generation chamber having a defined corner wherein the partition walls are in direct contact with the vibrating wall;

and a resin portion having a recessed arc-shape and formed along the defined corner of the pressure generation chamber and formed of a resin material having a Young's modulus of less than or equal to 10 GPa, wherein a ratio r/w of a radius r of the surface of the resin portion to a width w of the pressure generation chamber defined by the vibrating wall is greater than or equal to 0.017 and less than or equal to 0.087.

2. The liquid ejecting head according to claim 1, further comprising:

a protective film provided on an inner wall surface of the pressure generation chamber, wherein the protective film is formed of silicon oxide, zirconium oxide, nickel or chromium.

3. The liquid ejecting head according to claim 1, further comprising:

a protective film provided on an inner wall surface of the pressure generation chamber, wherein the protective film is configured of an epoxy-based resin.

4. The liquid ejecting head according to claim 1, further comprising:

a protective film provided on an inner wall surface of the pressure generation chamber, wherein the resin portion is formed on the protective film.

5. The liquid ejecting head according to claim 1, wherein the resin portion is configured of an adhesive.

6. The liquid ejecting head according to claim 1, wherein the resin portion is formed by curing at a temperature range from 25 degree Celsius to 150 degree Celsius.

7. The liquid ejecting head according to claim 1, wherein the vibrating wall is configured of a partition wall of the pressure generation chamber.

8. The liquid ejecting head according to claim 1, wherein the resin portion is configured of an epoxy-based adhesive.

9. A liquid ejecting apparatus comprising the liquid ejecting head according to claim 1.

10. The liquid ejecting head of claim 1, wherein the corner is defined by two walls of the chamber where the two walls meet and the resin portion is disposed in the corner along where the two walls meet.

11. A liquid ejecting head, comprising:

a pressure generation chamber communicating with a nozzle opening, wherein partition walls define a side-wall surface of the pressure generation chamber and a vibrating wall that vibrates so as to eject liquid from the nozzle opening defines a top surface of the pressure generation chamber, the pressure generation chamber having a defined corner where the partition walls meet the vibrating wall;

a resin portion having a recessed arc-shape and formed along the defined corner of the pressure generation chamber and formed of a resin material having a Young's modulus of less than or equal to 10 GPa, wherein a ratio r/w of a radius r of the surface of the resin portion to a width w of the pressure generation chamber defined by the vibrating wall is greater than or equal to 0.017 and less than or equal to 0.087 wherein the partition walls contact the vibrating wall through an adhesive of a different material than a material that forms the resin portion.

12. The liquid ejecting head according to claim 11, wherein the vibrating wall is configured of a partition wall of the pressure generation chamber.

13. The liquid ejecting head according to claim 11, wherein the resin portion is configured of an epoxy-based adhesive.

14. A liquid ejecting head, comprising:

a pressure generation chamber communicating with a nozzle opening, wherein partition walls define a side-wall surface of the pressure generation chamber and a vibrating wall that vibrates so as to eject liquid from the nozzle opening defines a top surface of the pressure generation chamber, the pressure generation chamber having a defined corner where the partition walls contact the vibrating wall, wherein the partition walls contact the vibrating wall through an adhesive;

a resin portion having a recessed arc-shape and formed along the defined corner of the pressure generation chamber and formed of a resin material having a Young's modulus of less than or equal to 10 GPa, wherein a ratio r/w of a radius r of the surface of the resin portion to a width w of the pressure generation chamber defined by the vibrating wall is greater than or equal to 0.017 and less than or equal to 0.087, wherein the resin portion is discontinuous with the adhesive between the partition walls and the vibrating wall.

15. The liquid ejecting head of claim 14, further comprising:

a protective film provided on an inside surface of the pressure generation chamber such that the protective film is disposed between the resin portion and the adhesive.

16. The liquid ejecting head according to claim 14, wherein the vibrating wall is configured of a partition wall of the pressure generation chamber.

17. The liquid ejecting head according to claim 14, wherein the resin portion is configured of an epoxy-based adhesive.

* * * * *